US008157590B2

(12) United States Patent
Yamakami et al.

(10) Patent No.: US 8,157,590 B2
(45) Date of Patent: Apr. 17, 2012

(54) JACK SIDE CONNECTOR AND CONNECTOR SET HAVING THE JACK SIDE CONNECTOR

(75) Inventors: Toru Yamakami, Shinagawa (JP); Takeshi Okuyama, Shinagawa (JP); Tadashi Kumamoto, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/830,521

(22) Filed: Jul. 6, 2010

(65) Prior Publication Data

US 2011/0014819 A1 Jan. 20, 2011

(30) Foreign Application Priority Data

Jul. 15, 2009 (JP) ..... 2009-166275

(51) Int. Cl.
*H01R 13/648* (2006.01)

(52) U.S. Cl. ..... 439/607.05; 439/924.1

(58) Field of Classification Search ..... 439/607.05, 439/607.08, 607.09, 607.1–607.15, 924.1, 439/924.2

See application file for complete search history.

(56) References Cited

U.S. PATENT DOCUMENTS

2001/0051450 A1* 12/2001 Ross ..... 439/78
2006/0281354 A1* 12/2006 Ngo et al. ..... 439/290

FOREIGN PATENT DOCUMENTS

JP 2-216773 8/1990

* cited by examiner

*Primary Examiner* — Ross Gushi
(74) *Attorney, Agent, or Firm* — IPUSA, PLLC

(57) ABSTRACT

A jack side connector configured to be connected to a plug side connector, the plug side connector including a plug side signal contact and a plug side ground contact extending from a holding part, the jack side connector includes a jack side signal contact and a jack side ground contact configured to come in contact with the plug side signal contact and the plug side ground contact, respectively, so that electric conduction between the plug side connector and the jack side connector is made when the plug side connector is connected to the jack side connector, wherein the jack side ground contact includes a first contact part and a second contact part, and when the plug side connector is connected to the jack side connector, the electric conduction between the plug side connector and the jack side connector is made by the first contact part and the second contact part.

6 Claims, 6 Drawing Sheets

JACK SIDE CONNECTOR AND CONNECTOR SET HAVING THE JACK SIDE CONNECTOR

CROSS-REFERENCE TO RELATED APPLICATIONS

This patent application is based upon and claims the benefit of priority of Japanese Patent Application No. 2009-166275 filed on Jul. 15, 2009 the entire contents of which are incorporated herein by reference.

BACKGROUND OF THE INVENTION

1. Field of the Invention

The present invention generally relates to jack side connectors and connector sets having the jack side connectors. More specifically, the present invention relates to a balanced transmission connector set and a jack side connector of the balanced transmission connector set.

2. Description of the Related Art

Conventionally, as a transmission method of transmitting data by a computer or between boards, unbalanced transmission or balanced transmission has been applied. In the unbalanced transmission, a signal is transmitted as a voltage relative to a ground electrical potential. In the balanced transmission, a pair of two equivalent signal lines is used and a signal is transmitted as an electrical potential difference between the signal lines. Since the balanced transmission has advantage in that, compared to the unbalanced transmission, noise may not have an influence, an area where the balanced transmission is used is expanding.

As a connector set for balanced transmission, a plug side connector and a jack side connector are used. In the plug side connector, plug side ground contacts formed of long plate shaped conductors and plug side signal contacts where conductors are provided at both end parts of long plate shaped insulators are mutually formed. The plug side contact is inserted in the jack side contact. The plug side signal contact is not limited to the above-mentioned example and may have a configuration where a pair of the conductors projects.

The jack side connector includes a jack side signal contact and a jack side ground contact which come in contact with the conductors so that conduction between the plug side and the jack side is formed.

In the plug side signal contact, a conductor provided at one side of the insulator transmits a + signal to the jack side signal contact. A conductor provided at another side of the insulator transmits a − signal to the jack side signal contact.

The plug side ground contact provides a ground electric potential at the plug side and the jack side. The plug side ground contact, together with the jack side ground contact, electromagnetically neighbor signal contacts.

In the meantime, it may be preferable that, in order to securely maintain a conducting state, a portion where the plug side contact and the jack side contact come in contact with each other be pressed and held in contact by a repulsive force of a contact members, a spring member, or the like.

For example, Japanese Laid-Open Patent Application Publication No. 2-216773 describes an invention of a connector for electric connecting, the connector having the above-mentioned feature.

In this connector for electric connecting, a donut-shaped slit is formed so as to extend in a longitudinal direction of a stick-shaped contact (corresponding to the plug side contact) to be inserted. This slit is sandwiched by a U-shaped contact (corresponding to the jack side contact). By a force received from the U-shaped contact, the stick-shaped contact is bent toward a center axial side of engagement. By the repulsive force of the stick-shaped contact, press contact of the contacts is strengthened.

However, if the connector for electric connecting described in Japanese Laid-Open Patent Application Publication No. 2-216773 is applied to, especially, the ground contact in the balanced transmission, it may be difficult to correspond to recent high frequency signal transmissions (electric power transmissions).

In the connector for electric connecting described in Japanese Laid-Open Patent Application Publication No. 2-216773, the stick shaped contact projects to a deeper side than a contact position of the stick-shaped contact and the U-shaped contact. Such a projecting part may be called a stub. Because of this, the signal (electrical current) to be transferred is returned from a head end so that noise may be generated.

SUMMARY OF THE INVENTION

Accordingly, embodiments of the present invention may provide a novel and useful jack side connector and connector set including the jack side connector solving one or more of the problems discussed above.

More specifically, the embodiments of the present invention may provide a jack side connector which can correspond to high frequency transmission and a connector set including the jack side connector.

Another aspect of the embodiments of the present invention may be to provide a jack side connector configured to be connected to a plug side connector, the plug side connector including a plug side signal contact and a plug side ground contact extending from a holding part, the jack side connector including:

a jack side signal contact and a jack side ground contact configured to come in contact with the plug side signal contact and the plug side ground contact, respectively, so that electric conduction between the plug side connector and the jack side connector is made when the plug side connector is connected to the jack side connector, wherein the jack side ground contact includes a first contact part configured to come in contact with the plug side ground contact in a direction perpendicular to a longitudinal direction of the plug side ground contact, a second contact part configured to come in contact with the plug side ground contact at a deeper side of the jack side connector compared to the first contact part, and when the plug side connector is connected to the jack side connector, the electric conduction between the plug side connector and the jack side connector is made by the first contact part and the second contact part.

Another aspect of the embodiments of the present invention may be to provide a connector set, including:

the above-mentioned jack side connector; and a plug side connector including a plug side signal contact and a plug side ground contact extending from the holding part, wherein a notch part is formed in the plug side ground contact from a head end part at a designated length in the longitudinal direction of the plug side ground contact and at a center part in a direction perpendicular to the longitudinal direction of the plug side ground contact.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description of a connector set 1 is given below, with reference to the FIG. 1 through FIG. 7 of embodiments of the present invention.

(Basic Structure)

Figure 1:
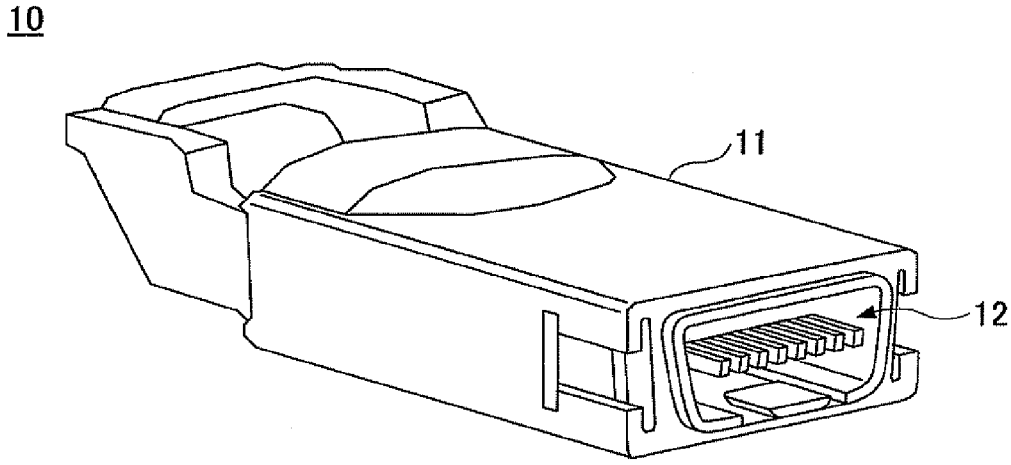
FIG. 1 is a perspective view of a plug side connector 10 of an embodiment of the present invention.
Figure 2:
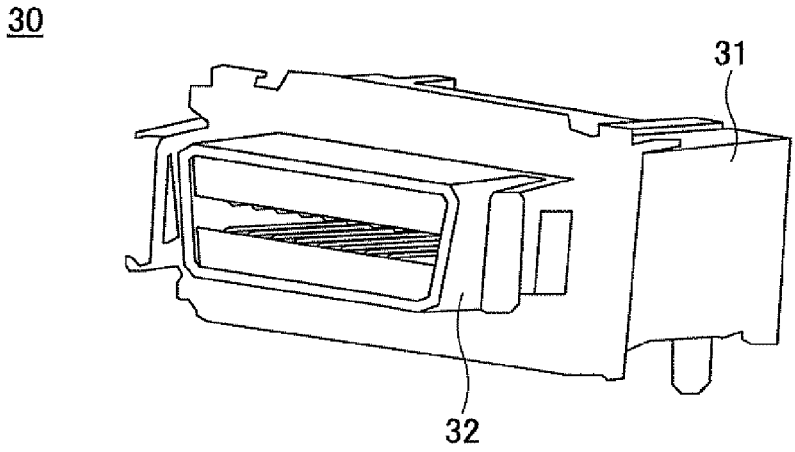
FIG. 2 is a perspective view of a jack side connector 30 of the embodiment of the present invention.

FIG. 1 is a perspective view of a plug side connector 10 of an embodiment of the present invention. FIG. 2 is a perspective view of a jack side connector 30 of the embodiment of the present invention.

The connector set 1 is a balanced transmission connector including the plug side connector 10 and the jack side connector 30. In the connector set 1, by connecting the plug side connector 10 into the jack side connector 30, electric conduction of cables or boards connected to each of the connectors 10 and 30 is formed so that a signal or electric power is transmitted.

Figure 3:
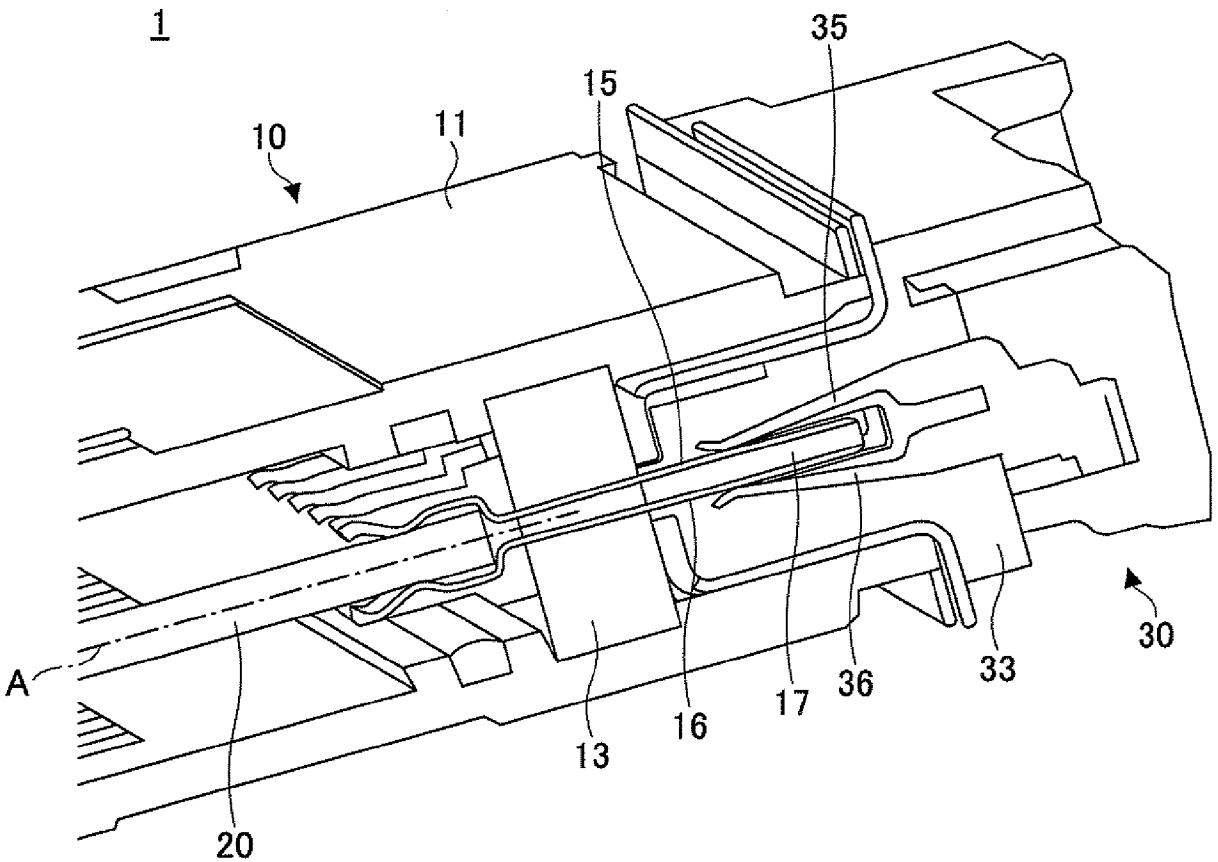
FIG. 3 is a cross-sectional perspective view of a connector set 1 in a state where the plug side connector 10 is connected to the jack side connector 30, including a cross-sectional view of a signal contact.
Figure 4:
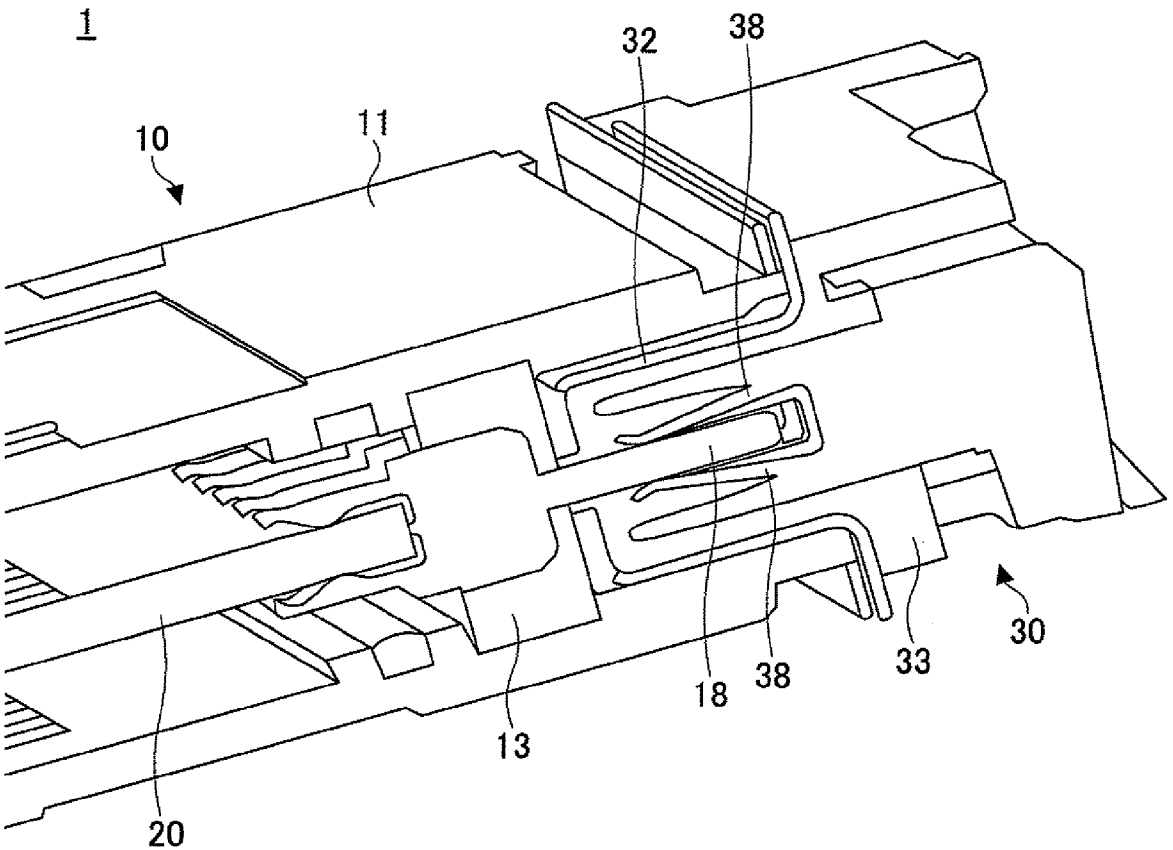
FIG. 4 is a detailed cross-sectional view of the connector set 1 in a state where the plug side connector 10 is connected to the jack side connector 30, including a cross-sectional view of a ground contact.

FIG. 3 is a cross-sectional view of a connector set 1 in a state where the plug side connector 10 is connected to the jack side connector 30, including a cross-sectional view of a signal contact. FIG. 4 is a detailed cross-sectional view of the connector set 1 in a state where the plug side connector 10 is connected to the jack side connector 30, including a cross-sectional view of a ground contact.

(Plug Side)

First, a basic structure and others of the plug side connector 10 are discussed. The plug side connector 10 includes a housing 11. The housing 11 is a molded component which is formed by molding synthetic resin having electrical insulation properties (thermoplastic resin such as LCP (Liquid Crystal Polymer).

In a concave part 12 (see FIG. 1) of the housing 11, plug side signal contacts 15 and 16 and a plug side ground contact 18 extend from a holding part 13 to a jack side connector 30 side. The holding part 13 is configured to form a bottom part of the concave part 12.

One of the plug side signal contacts 15 and 16 transmits a signal and another of the plug side signal contacts 15 and 16 transmits a – signal. In addition, the plug side signal contacts 15 and 16 are held by an insulator 17 so as to face each other at a distance. Hereinafter, a unit formed by the plug side signal contacts 15 and 16 and the insulator 17 is called a plug side signal contact unit.

The plug side signal contact unit and a plug side ground contact 18 (see FIG. 4) are mutually arranged separated by a certain distance. The plug side signal contacts 15 and 16 and the plug side ground contact 18 are formed of a conductive metal material. The plug side ground contact 18 is formed of a conductive metal member (spring member) having a certain degree of elasticity.

The plug side signal contacts 15 and 16 are connected to a board 20 inserted in the housing 11 at a side opposite to the jack side connector 30 side. The board 20 is provided so that, as shown by a dotted line A in FIG. 3, a center line of the plug side signal contact unit is consistent with a center line of the board 20 in a thickness direction. Each of leads (not illustrated) configured to connect the plug side signal contacts 15 and 16 to the board 20 is connected a different surface of the board 20.

The leads (not illustrated) configured to connect the plug side signal contacts 15 and 16 to the board 20 are connected to different surfaces of the board 20 and are substantially the same length so that electric characteristics of a signal transmission path and a – signal transmission path are not different from each other.

The plug side ground contact 18 and the plug side signal contact unit formed by the plug side signal contacts 15 and 16 and the insulator 17 have the substantially same configuration and size. Ground electrical potential is provided to the plug side connector 10 and the jack side connector 30 by the plug side ground contact 18. Since the plug side ground contact 18 is positioned between neighboring plug side signal contact units, electromagnetic interference between neighboring plug side signal contact units can be prevented (eased).

At a side opposite to a side where the plug side connector 10 is connected to the jack side connector 30, the board 20 is connected to a high speed transmission cable (not illustrated) or the like. As the high speed transmission cable, for example, a twisted pair cable, where a signal line which is a pair of core lines made of copper, an insulator made of resin, and a ground line are covered with a protection film made of resin, is used. The pair of core lines is connected to a pair of the plug side signal contacts and the ground line is connected to a plug side ground contact.

(Plug Side)

Next, a basic structure or the like of the jack side connector 30 is discussed. The jack side connector 30 includes a housing 31 (see FIG. 2). The housing 31 is made of a material the same as that of the housing 11 of the plug side connector 10.

A guide part 32 is provided at the housing 31 (see FIG. 2). The guide part 32 is configured to be engaged with the concave part 12 of the housing 11 of the plug side connector 10. Jack side signal contacts 35 and 36 (see FIG. 3) and a jack side ground contact 38 (see FIG. 4) are provided inside the guide part 32 so as to extend from a holding part 33 to a plug side connector 10 side. The jack side signal contacts 35 and 36 are configured to be engaged with the plug side contact unit. The jack side ground contact 38 is configured to be engaged with the plug side ground contact 18.

As discussed above, the plug side signal contact units and adjacent plug side ground contacts (see FIG. 4) are mutually arranged separated by a certain distance. Corresponding to this, the jack side signal contacts 35 and 36 and the jack side ground contact 38 are mutually arranged separated by a certain distance.

When the plug side connector 10 is connected to the jack side connector 30, the jack side signal contacts 35 and 36 sandwich the corresponding plug side signal contact units and the jack side ground contacts 38 sandwich the corresponding plug side ground contacts 18 in a direction perpendicular to a longitudinal direction of the jack side connector 30.

The jack side signal contacts 35 and 36 and the jack side ground contact 38 are formed of conductive metal (spring member) having a certain degree of elasticity.

The jack side signal contacts 35 and 36 and the jack side ground contact 38 are connected to a printed wiring board or the like via a lead on, for example, a surface perpendicular to a surface where the plug side connector 10 is connected. An inserting hole, where a fixing screw (not illustrated) for connecting the printed wiring board or the like is inserted, is formed in the housing 31.

Under this structure, when the plug side connector 10 is connected to the jack side connector 30, the jack side signal contacts 35 and 36 and the jack side ground contact 38 are expanded, by the inserted plug side contact, slightly outside relative to an engagement center line.

In the jack side connector 30, the jack side signal contacts 35 and 36 and the jack side ground contact 38 press and contact the inserted plug side contacts with an elastic restoring force so as to electrically and stably make connection with the corresponding plug side contacts. As a result of this, the printed wiring board or the like and an apparatus connected to a head of the high speed cable connected to the plug side connector 10 are electrically connected to each other.

The plug side connector 10 may be connected to the printed wiring board or the like and the jack side connector 30 may be connected to the high speed transmission cable. Both the plug side connector 10 and the jack side connector 30 may be connected to high speed transmission cables. Both the plug side connector 10 and the jack side connector 30 may be connected to printed wiring boards or the like.

(Details of the Structure)

In general, a contact portion of the plug side contact and the jack side contact may be situated in the vicinity of the head end of the jack side contact, namely the vicinity of the entrance of the jack side connector. This is because if the above-mentioned contact portion is not separated from a bottom part of the jack side contact at the head end, it may not be possible to sufficiently obtain the elastic deformation toward an outside.

Figure 5:
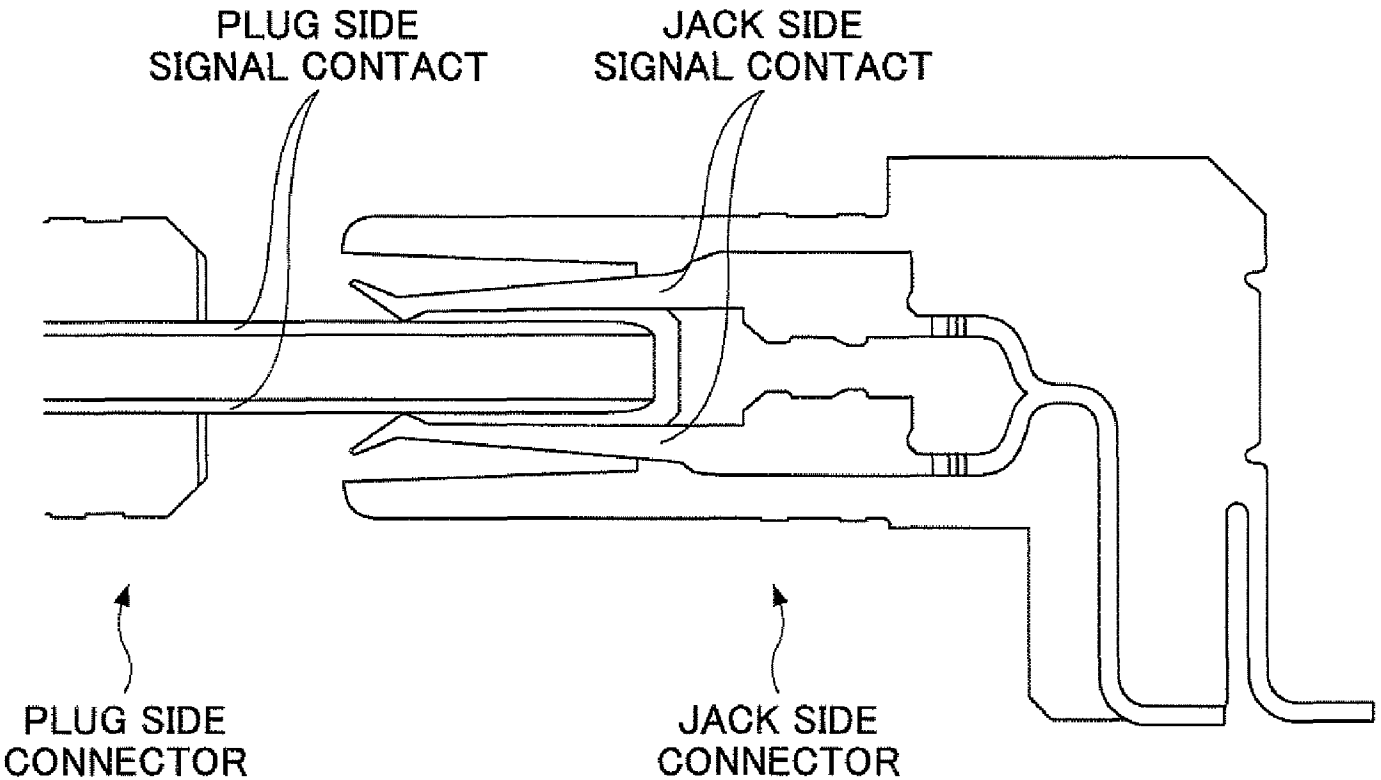
FIG. 5 is a cross-sectional view showing a state where a plug side signal contact comes in contact with a jack side signal contact so that electric conduction is made in a general connector set.
Figure 6:
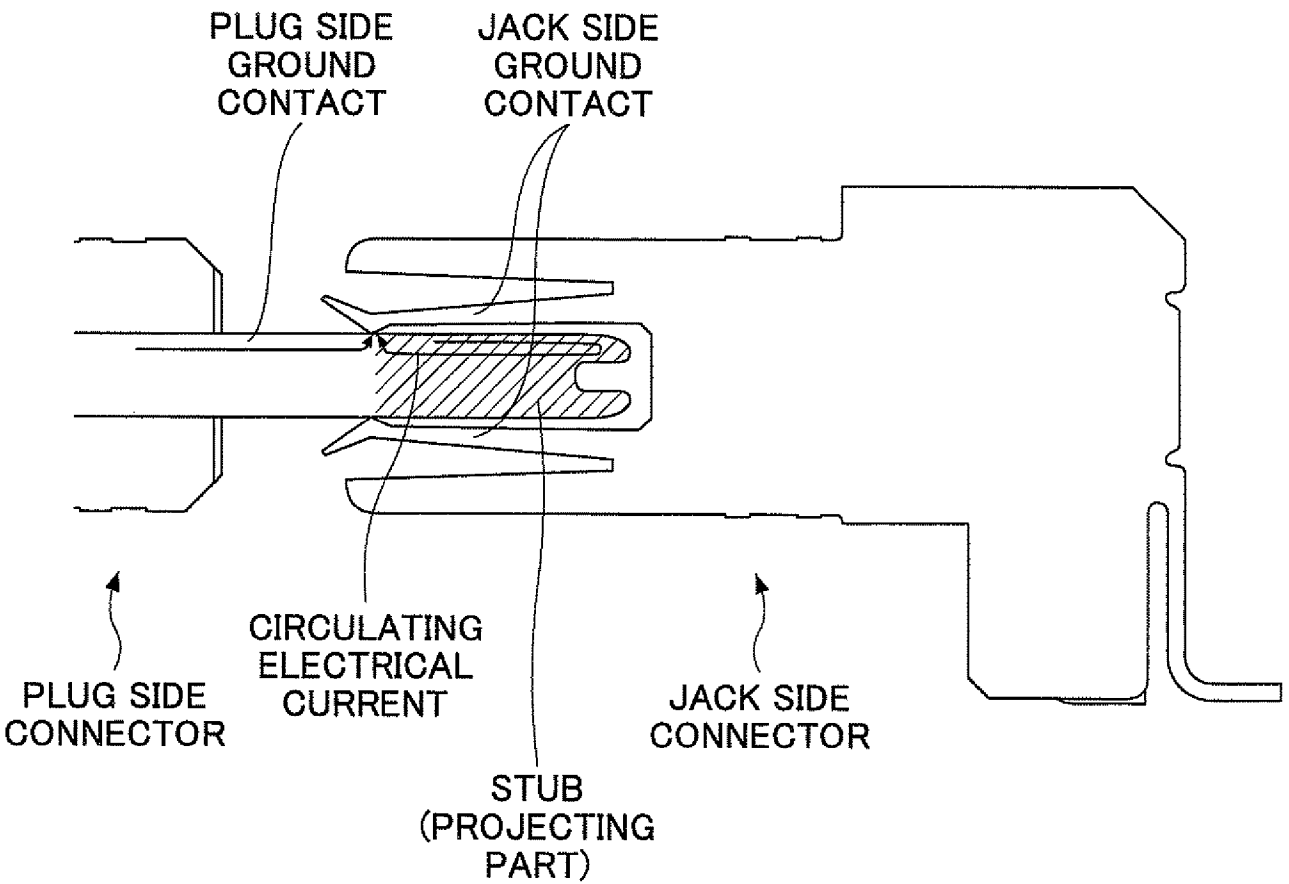
FIG. 6 is a cross-sectional view showing a state where a plug side ground contact comes in contact with a jack side ground contact so that electric conduction is made in a general connector set.

FIG. 5 is a cross-sectional view showing a state where a plug side signal contact comes in contact with a jack side signal contact so that electric conduction is made in a general connector set. FIG. 6 is a cross-sectional view showing a state where a plug side ground contact comes in contact with a jack side ground contact so that electric conduction is made in a general connector set.

Under structures shown in FIG. 5 and FIG. 6, in a case where the high frequency signal transmission (electric power transmission) is made, noise may be generated at a transmission path where ground contacts come in contact with each other. This phenomenon may occur due to a stub shown in FIG. 6, the stub being a portion of the plug side ground contact projecting deeper than a contact position of the plug side ground contact and the jack side ground contact. When the high frequency signal transmission (electric power transmission) is made, an electric current may circulate from the stub to the contact portion so that noise may be generated.

In order to solve this problem, ground contacts may be in contact with each other only at a deep side of the jack side connector 30. However, in this case, when the plug side connector 10 is connected to the jack side connector 30, signal contacts come in contact with each other first and therefore online insertion and removal cannot be performed. In order to perform the online insertion and removal, it is necessary that the ground contacts come in contact with each other before the signal contacts do when the plug side connector 10 is being inserted into the jack side connector 30; and the ground contacts do not break contact with each other until after the signal contacts do when the plug side connector 10 is being removed from the jack side connector. That is, in order to realize the online insertion and removal, it is necessary that contact parts coming in contact with the plug side ground contacts in the vicinity of the head end of the jack side ground contacts are situated at the head end side of the jack side ground contacts more than portions where the plug side signal contacts and the jack side signal contacts come in contact with each other.

In addition, the plug side ground contact 18 and the jack side ground contact 38 may be in contact with each other in a wide range (for example, from a head end to a bottom part). However, assuming that pressing and contacting is made by the elastic restoring force, this case may be unrealistic.

Because of this, the connector set 1 of the embodiment of the present invention has the following structure.

Figure 7:
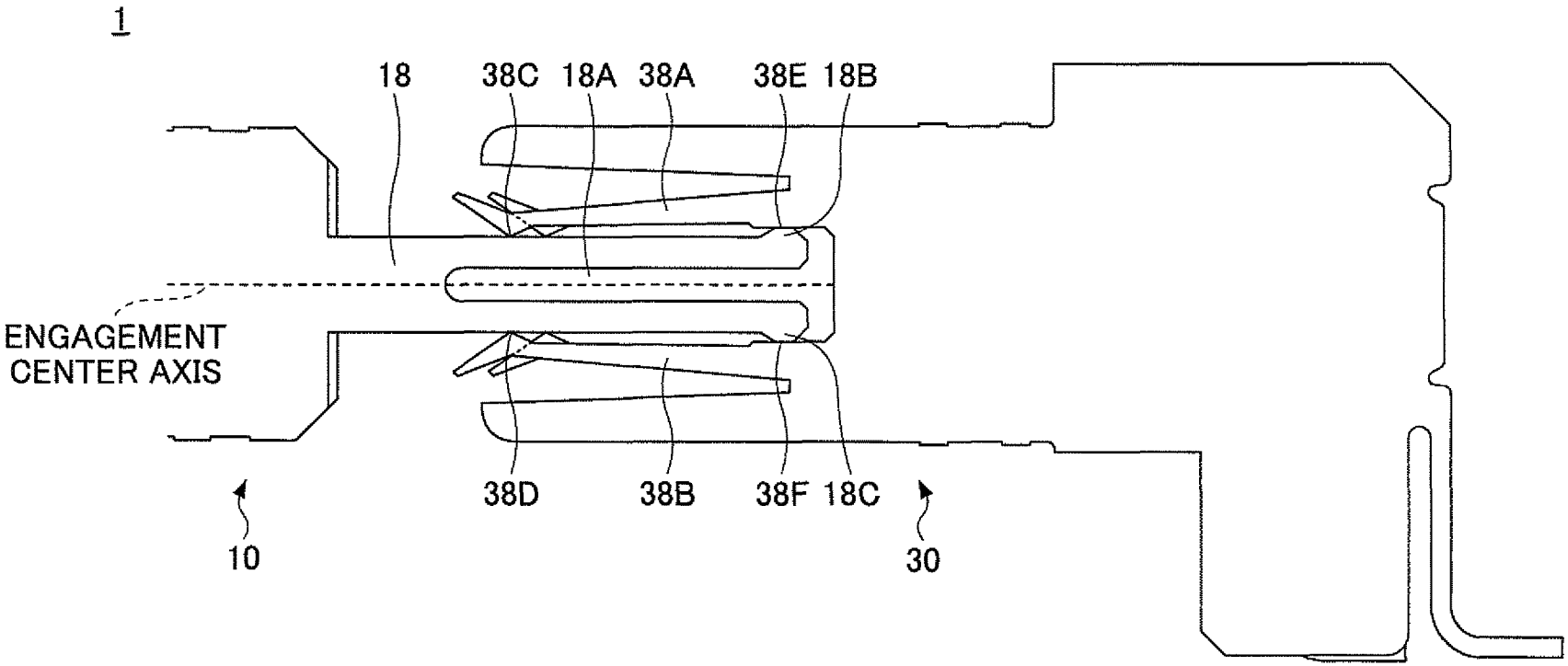
FIG. 7 is a cross-sectional view of the connector set 1 in a state where the plug side connector 10 is connected to the jack side connector 30, including a cross-sectional view of a signal contact.

FIG. 7 is a cross-sectional view of the connector set 1 in a state where the plug side connector 10 is connected to the jack side connector 30, including a cross-sectional view of a ground contact.

The jack side ground contact 38 includes arm parts 38A and 38B configured to sandwich the plug side ground contact 18. Claw-shaped first contact parts 38C and 37D are formed in the vicinity of head ends of the corresponding arm parts 38A and 38B so that the arm parts 38A and 38B come in contact with the plug side ground contact 18 in a direction perpendicular to the longitudinal direction of the plug side ground contact 18.

In the vicinity of the bottom (base) parts of the arm parts 38A and 38B, namely a side of the jack side connector 30 deeper than the first contact parts 38C and 38D, trapezoidal-shaped second contact parts 38E and 38F are formed so as to come in contact with projection parts 18B and 18C of the plug side ground contact 18. The jack side ground contact 38 comes in contact with the plug side ground contact 18 at four parts at two sides (two parts at a single side).

A pair of the first contact parts 38C and 38D is formed in a symmetrical manner with respect to the engagement center axis so as to come in contact with the plug side ground contact 18 from both sides in a direction perpendicular to the longitudinal direction of the jack side ground contact 38. Similarly, a pair of the second contact parts 38E and 38F is formed in a symmetrical manner with respect to the engagement center axis so as to come in contact with the plug side ground contact 18 from both sides in a direction perpendicular to the longitudinal direction of the jack side ground contact 38.

On the other hand, a notch part 18A is formed in the plug side ground contact 18 from a head end part with a designated length in a longitudinal direction of the plug side ground contact 18 and at a center part in a direction perpendicular to the longitudinal direction of the plug side ground contact 18. As discussed above, the projection parts 18B and 18C are formed at corresponding sides of the head end part of the plug side ground contact 18 so that the plug side ground contact 18 at the projection parts 18B and 18C is wide. Here, a designated length is where elastic deformation discussed below can be sufficiently obtained.

When the plug side connector 10 is inserted in the jack side connector 30, the first contact parts 38C and 38D are pressed by the plug side ground contact 18 toward an outside, as seen from the engagement center axis, and press and contact the plug side ground contact 18 by a restoring force. On the other hand, the projecting second contact parts 38E and 38F press the corresponding projection parts 18B and 18C of the plug side ground contact 18 to the engagement center axis side and are pressed and contacted by the plug side ground contact 18 by a restoring force of the plug side ground contact 18.

As a result of this, the electric current flowing to the head end side of the plug side ground contact 18 does not circulate to the first contact parts 38C and 38D but flows to the projecting second contact parts 38E and 38F. Therefore, it is possible to prevent (ease) the generation of noise in the high frequency transmission.

In addition, since the elastic restoring forces of both the plug side ground contact 18 and the jack side ground contact 38 are used, it is possible to stably maintain the conductive state between the plug side connector 10 and the jack side connector 30.

In addition, the first contact parts 38C and 38D, compared to portions where the plug side signal contacts 15 and 16 and the jack side signal contacts 35 and 36 come in contact with each other, can be situated at a head end side. In other words, the portions where the plug side signal contacts 15 and 16 and the jack side signal contacts 35 and 36 come in contact with each other can be positioned, in the longitudinal direction of the plug side signal contact and the plug side ground contact, between the first contact parts 38C and 38D and the projecting second contact parts 38E and 38F. Therefore, it is possible to realize the connector set which can perform the online insertion and removal.

The amount of noise generated at the signal transmission path due to the stub is smaller than that at the ground transmission path. Therefore, as examples of the plug side signal contacts 15 and 16 and the jack side signal contacts 35 and 36, examples shown in FIG. 5 may be applied.

Thus, according to the connector set 1 of the embodiment of the present invention, it is possible to prevent (ease) generation of or contamination by noise at the high frequency transmission.

In addition, it is possible to stably maintain the conductive state and to provide the connector which can be used for the online insertion and removal.

According to the embodiments of the present invention, it is possible to provide a jack side connector configured to be connected to a plug side connector, the plug side connector including a plug side signal contact and a plug side ground contact extending from a holding part, the jack side connector including:

a jack side signal contact and a jack side ground contact configured to come in contact with the plug side signal contact and the plug side ground contact, respectively, so that electric conduction between the plug side connector and the jack side connector is made when the plug side connector is connected to the jack side connector, wherein the jack side ground contact includes a first contact part configured to come in contact with the plug side ground contact in a direction perpendicular to a longitudinal direction of the plug side ground contact, and a second contact part configured to come in contact with the plug side ground contact at a deeper side of the jack side connector compared to the first contact part, and when the plug side connector is connected to the jack side connector, the electric conduction between the plug side connector and the jack side connector is made by the first contact part and the second contact part.

According to the above-mentioned jack side connector, it is possible to prevent (ease) generation of or contamination by noise at the high frequency transmission.

Each of the first contact part and the second contact part may be provided as a pair in a symmetrical manner with respect to an engagement center axis, and each of the pairs of the first contact part and the second contact part may be configured to come in contact with the plug side ground contact on both sides of the plug side ground contact in the direction perpendicular to a longitudinal direction of the plug side ground contact.

According to the embodiments of the present invention, it is also possible to provide a connector set, including:

the above-mentioned jack side connector; and a plug side connector including a plug side signal contact and a plug side ground contact extending from the holding part, wherein a notch part is formed in the plug side ground contact from a head end part at a designated length in the longitudinal direction of the plug side ground contact and at a center part in a direction perpendicular to the longitudinal direction of the plug side ground contact.

According to the above-mentioned connector set, it is possible to prevent (ease) generation of or contamination by noise at the high frequency transmission.

The plug side ground contact may include projection parts so that the plug side ground contact is wide at the projection parts.

The jack side ground contact may include an arm part, the arm part being configured to sandwich the plug side ground contact in a direction perpendicular to a longitudinal direction of the arm part when the plug side connector is connected to the jack side connector;

when the plug side connector may be connected to the jack side connector, the first contact part is pressed by the plug side ground contact toward an outside, as seen from an engagement center axis, and presses and contacts the plug side ground contact by a restoring force of the arm part; and when the plug side connector may be connected to the jack side connector, the second contact part presses the plug side ground contact to the engagement center axis side and is pressed and contacts the plug side ground contact by a restoring force of the plug side ground contact.

With this structure, it is possible to stably maintain conductive state of the plug side connector and the jack side connector.

When the plug side connector is connected to the jack side connector, a portion where the plug side signal contact and the jack side signal contact may come in contact with each other is positioned, in the longitudinal direction of the plug side signal contact and the plug side ground contact, between the first contact part and the second contact part.

With this structure, it is possible to provide the connector set which can be used for the online insertion and removal.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

For example, the plug side signal contacts 15 and 16 are not limited to the examples discussed above. The insulator may not be provided between the plug side signal contacts 15 and 16. In this case, the jack side signal contacts 35 and 36 may have configurations where the plug side signal contacts 15 and 16 are sandwiched by the jack side signal contacts 35 and 36. Alternatively, the jack side signal contacts 35 and 36 may have configurations where the plug side signal contacts 15 and 16 are pressed and contacted at a single side.

The jack side connector 30 of the embodiment may include a cover where a slit is formed, the slit being configured to receive the plug side contact.

The embodiments of the present invention can be applied to a manufacturing business of a computer, its periphery device, or the like.

What is claimed is:

1. A connector set, comprising:

a jack side connector configured to be connected to a plug side connector, the plug side connector including a plurality of plug side linear signal contacts and plug side linear ground contacts extending from a holding part, wherein the jack side connector includes a plurality of jack side signal contacts and jack side ground contacts configured to come in contact with the plug side linear signal contacts and the plug side linear ground contacts respectively, so that electric conduction between the plug side connector and the jack side connector is made when the plug side connector is connected to the jack side connector, wherein each of the jack side ground contacts includes a first contact part configured to come in contact with the plug side linear ground contact at a first linear point in a direction perpendicular to a longitudinal direction of the ping side linear ground contact, and a second contact part configured to come in contact with the plug side linear ground contact at a second linear point located along the plug side linear ground contact, in a substantially horizontal direction at a location further inside of the jack side connector compared to the first linear point, when the plug side connector is connected to the jack side connector, the electric conduction between the plug side connector and the jack side connector is made by the first contact part and the second contact part, wherein a notch part is formed in the plug side linear ground contact from a head end part at a designated length in the longitudinal direction of the plug side linear ground contact, and wherein the jack side ground contact includes an arm part, the arm part being configured to sandwich the plug side linear ground contact in a direction perpendicular to a longitudinal direction of the arm part when the plug side linear connector is connected to the jack side connector, when the plug side connector is connected to the jack side connector, the first contact part is pressed by the plug side linear ground contact toward an outside, as seen from an engagement center axis, and presses and contacts the plug side linear ground contact by a restoring force of the arm part; and when the plug side connector is connected to the jack side connector, the second contact part presses the plug side linear ground contact to the engagement center axis side and is pressed and contacts the plug side linear ground contact by a restoring force of the plug side linear ground contact.

2. The connector set as claimed in claim 1, wherein each of the first contact part and the second contact part is provided as a pair in a symmetrical manner with respect to an engagement center axis, and each of the pairs of the first contact part and the second contact part is configured to come in contact with the plug side linear ground contact on both sides of the plug side linear ground contact in the direction perpendicular to a longitudinal direction of the plug side linear ground contact.

3. The connector set as claimed in claim 1, wherein the plug side linear ground contact includes projection parts so that the plug side linear ground contact is wide at the projection parts.

4. A connector set, comprising:

a jack side connector configured to be connected to a plug side connector, the plug side connector including a plurality of plug side signal contacts and plug side ground contacts extending from a holding part, wherein the plug side connector is separate from and physically distinct from the jack side connector, wherein the jack side connector includes a plurality of jack side signal contacts and jack side ground contacts configured to come in contact with the plug side signal contacts and the plug side ground contacts respectively, so that electric conduction between the plug side connector and the jack side connector is made when the plug side connector is connected to the jack side connector, wherein each of the jack side ground contacts includes a first contact part configured to come in contact with the plug side ground contact in a direction perpendicular to a longitudinal direction of the plug side ground contact, and a second contact part configured to come in contact with the plug side ground contact at a deeper side of the jack side connector compared to the first contact part, when the plug side connector is connected to the jack side connector, the electric conduction between the plug side connector and the jack side connector is made by the first contact part and the second contact part, wherein a notch part is formed in the plug side ground contact from a head end part at a designated length in the longitudinal direction of the plug side ground contact, and wherein the jack side ground contact includes an arm part, the arm part being configured to sandwich the plug side ground contact in a direction perpendicular to a longitudinal direction of the arm part when the plug side connector is connected to the jack side connector, when the plug side connector is connected to the jack side connector, the first contact part is pressed by the plug side ground contact toward an outside, as seen from an engagement center axis, and presses and contacts the plug side ground contact by a restoring force of the arm part, and when the plug side connector is connected to the jack side connector, the second contact part presses the plug side ground contact to the engagement center axis side and is pressed and contacts the plug side ground contact by a restoring force of the plug side ground contact.

5. The connector set as claimed in claim 4, wherein each of the first contact part and the second contact part is provided as a pair in a symmetrical manner with respect to an engagement center axis, and each of the pairs of the first contact part and the second contact part is configured to come in contact with the plug side round contact on both sides of the plug side ground contact in the direction perpendicular to a longitudinal direction of the plug side ground contact.

6. The connector set as claimed in claim 4, wherein the plug side ground contact includes projection parts so that the plug side ground contact is wide at the projection parts.

* * * * *